US005386889A

United States Patent [19]

Pipes

[11] Patent Number: 5,386,889

[45] Date of Patent: Feb. 7, 1995

[54] BRAKE MECHANISM FOR A STORAGE AND RETRIEVAL VEHICLE

[75] Inventor: George R. Pipes, Salt Lake City, Utah

[73] Assignee: Eaton-Kenway, Inc., Salt Lake City, Utah

[21] Appl. No.: 102,182

[22] Filed: Aug. 4, 1993

[51] Int. Cl.[6] ..... B65H 59/10

[52] U.S. Cl. ..... 188/67; 188/136; 188/343; 187/372

[58] Field of Search ..... 188/67, 62, 44, 156, 188/157, 161, 163, 171, 173, 188, 181 A, 136, 343; 187/89, 90, 83, 88, 86, 73, 82

[56] References Cited

U.S. PATENT DOCUMENTS

| | | | |
|---|---|---|---|
| 2,150,373 | 3/1939 | Hymans | 187/90 |
| 2,897,920 | 8/1959 | Falter | 187/88 |
| 3,601,227 | 8/1971 | Burch | 187/29 R |
| 3,762,512 | 10/1973 | McIntyre | 187/88 |
| 5,002,158 | 3/1991 | Erickson | 187/88 |
| 5,141,081 | 8/1992 | Kregel et al. | 187/87 |
| 5,159,995 | 11/1992 | Sissala et al. | 187/88 |
| 5,209,325 | 5/1993 | Gines et al. | 188/67 |

*Primary Examiner*—Robert J. Oberleitner
*Assistant Examiner*—Clifford T. Bartz
*Attorney, Agent, or Firm*—Frank M. Sajovec

[57] ABSTRACT

An overspeed brake mechanism for a storage and retrieval vehicle (SRV). The brake mechanism includes wedges acting between a brake block attached to the load carriage of the SRV and the mast of the SRV. The wedges are biased into engagement with the mast and are held out of engagement under normal operating conditions by electromagnets which apply an attractive force to the wedges, the electromagnets being de-energized by a control system responsive to an overspeed signal from a tachometer generator on the load carriage and having its input member in engagement with the mast. In accordance with a further aspect of the invention, permanent magnets imbedded in the wedges bias the wedges into light contact with the mast to insure that there will be no lost motion between the wedges and the mast when the brake is activated.

4 Claims, 5 Drawing Sheets

BRAKE MECHANISM FOR A STORAGE AND RETRIEVAL VEHICLE

The present invention relates to storage and retrieval vehicles (SRV), and more particularly to an overspeed brake mechanism for such vehicles.

Storage and retrieval vehicles typically include an overspeed brake device which is operable to stop the descent of the load carriage of the vehicle in the event of failure of the carriage lift mechanism, such as the severing of the carriage lift cable. In the SRV system to which the present invention is applied, the prior art overspeed brake consists of a toothed cam pivotally mounted on a brake block fixed to the load carriage and engageable with a surface formed on the mast. Actuation of the cam is accomplished by a linkage connected to a centrifugal speed sensing device.

While the prior art system has proved to be an effective safety device, the engagement of the cam teeth with the mast causes damage to the mast and can be difficult to disengage. Also, the centrifugal actuator requires a rack or other positive engagement device running essentially the full vertical length of the SRV mast for actuation.

In an SRV which employs a double mast, an overspeed brake is required on both masts in order to keep the load carriage level. In such application, it is difficult to mechanically link two brake assemblies to a single centrifugal sensing mechanism, and multiple centrifugal sensors are difficult to synchronize. U.S. Pat. No. 5,209,325 assigned to the assignee of this application and which is incorporated herein by reference, discloses a brake system for a double-masted SRV wherein a single, roller-driven generator energizes series-connected solenoids which actuate each of the brake mechanisms when the generated voltage reaches a value corresponding to an overspeed condition; however, that system still employs a toothed cam brake mechanism.

Accordingly, it is an object of the present invention to provide an overspeed brake system for a storage and retrieval vehicle which does not cause damage to the mast structure and which does not require an elongated rack or the like for actuation.

To meet the above objective, the present invention provides an overspeed brake which is in the form of a pair of opposed wedges acting on a guide rail fixed to the mast. The wedges are normally biased into engagement with the guide rail and during normal operation are held in a disengaged position. A tachometer generator senses the speed of the carriage relative to the mast and when an overspeed condition occurs energizes a circuit which is effective to remove the disengaging force, thus permitting the wedges to actively engage the guide rail and stop the movement of the load carriage relative to the mast. In accordance with a preferred embodiment of the invention, the wedges are held in a disengaged position by electromagnets.

In accordance with another aspect of the invention, the wedges are maintained in light engagement with the guide rail at all times by means of permanent magnets.

Other objects and advantages of the invention will be apparent from the following description, when taken in connection with the accompanying drawings, wherein.

Figure 1:
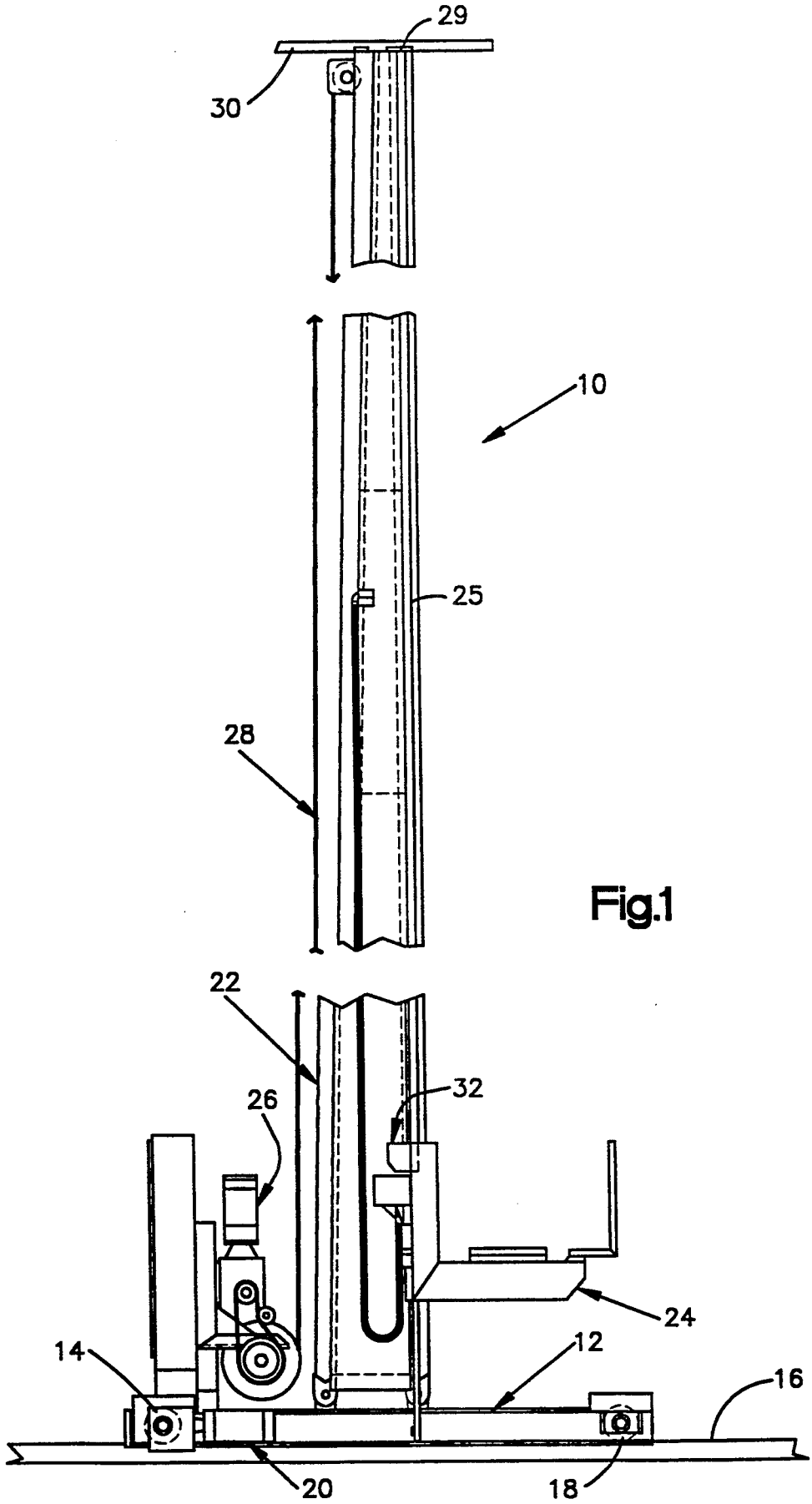
FIG. 1 is an elevation view of a storage and retrieval vehicle incorporating the invention.
Figure 2:
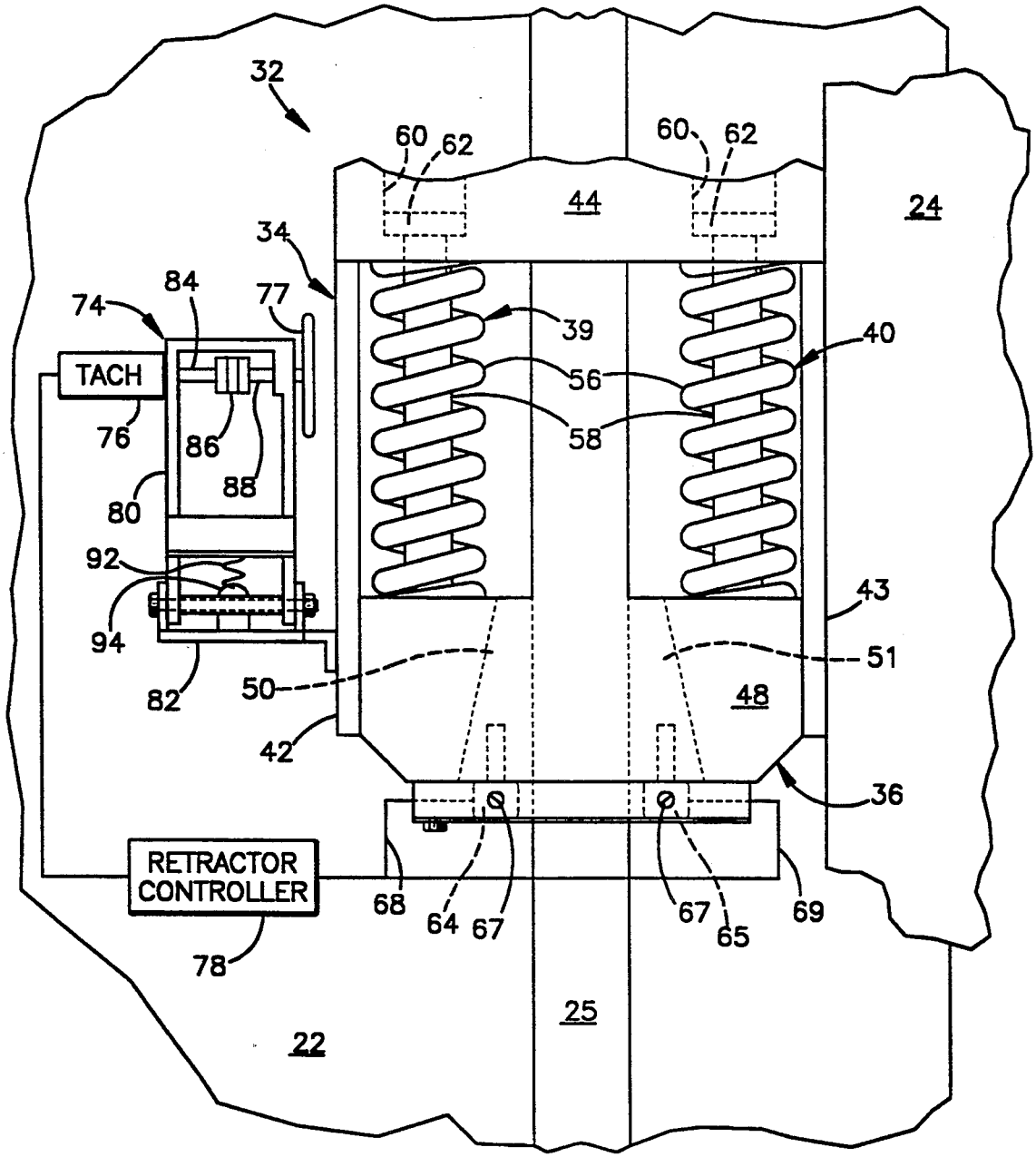
FIG. 2 is a schematic, front elevation view of a preferred embodiment of the invention.

Referring to FIG. 1, there is illustrated an SR vehicle 10 comprising a base assembly 12, a drive wheel 14 mounted for rotation on the frame 12 and engageable with a floor supported rail 16, an idler wheel 18 mounted for rotation on the frame and engageable with the rail 16, a drive motor assembly 20 mounted on the frame and operatively connected to the drive wheel to drive the SR vehicle along the rail, a mast assembly 22 mounted to the frame, a load carriage assembly 24 mounted to the mast assembly for vertical movement along a guide rail 25 attached to the mast, and a vertical drive assembly 26 mounted on the frame and operable to drive the load carriage up and down the mast by means of a cable system 28. The vehicle is stabilized by means of horizontal guide wheels 29 which engage an overhead rail 30.

The SR vehicle 10 includes an overspeed brake assembly 32 which is mounted on the load carriage 24 and which engages the guide rail 25 to stop downward travel of the load carriage in the event of a failure of the vertical drive system, such as breakage of the cable 28.

Referring to FIGS. 2–5, the brake assembly comprises a frame assembly 34 fixed to the load carriage 24. A brake block assembly 36 engageable with the guide rail 25, and energy absorber units 39 and 40 operable to cushion the shock loads which can occur upon actuation of the brake.

The frame assembly 34 comprises a pair of spaced apart side plates 42 and 43, one of which is fixed to the load carriage 24; an upper block 44 connecting the side plates; and retaining plates 46, 47 fixed to the brake block assembly in position to retain the wedges as will be described below.

Figure 4:
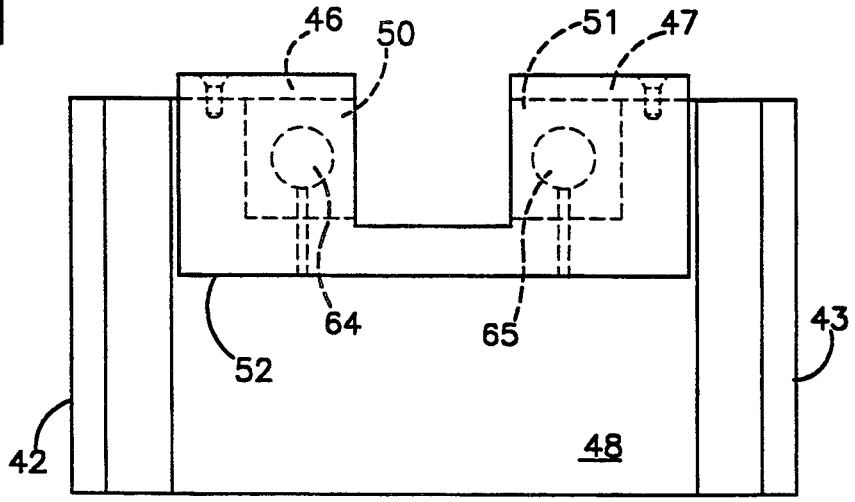
FIG. 4 is a bottom plan view of the embodiment of FIG. 2.
Figure 5:
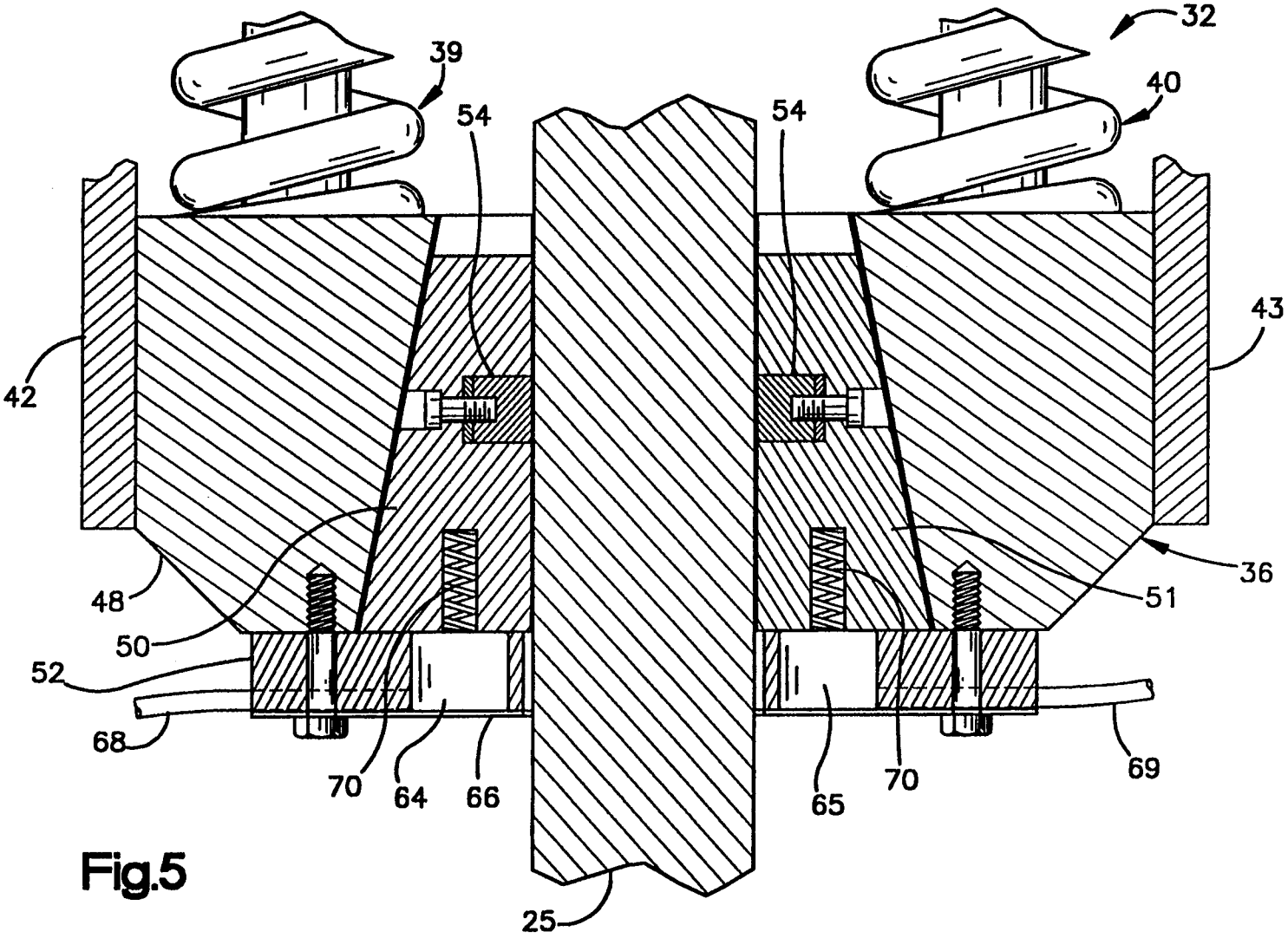
FIG. 5 is a partial section view taken at line 5—5 of FIG. 3.

Referring particularly to FIGS. 4 and 5, the brake block assembly 36 comprises a relatively massive U-shaped block 48 slidingly received between the side plates 42, 43; first and second wedge members 50, 51 received within the legs of the "U" in position to engage the guide rail 25; a bottom wedge retaining plate 52 bolted or otherwise fastened to the brake block, and permanent magnets 54 received in recesses formed in each of the wedges and operable to maintain the wedges in contact with the rail 25.

The shock absorbers 39 and 40 comprise pairs (only one of each shown in FIG. 2) of die springs 56 received between the brake block and the upper block 44 and stabilizer bars 58 received within the springs and threaded into the brake block. Each of the bars is received in a stepped bore 60 formed in the block 44 and has a head 62 formed on it which engages the block to support the brake block assembly during normal operation of the SR vehicle. Hydraulic shock absorbing units (not shown) can also be added to add damping to the shock absorbing system.

Referring particularly to FIG. 5, in the preferred embodiment electromagnets 64 and 65 are received in bores formed through the bottom wedge retainer 52 and retained axially by a plate 66. Set screws 67 received in the retainer can be used to prevent rotation of the electromagnets. Electrical cables 68 and 69 connect the electromagnets to a controller 78 as will be described in detail below. Coil springs 70 received in bores formed in the wedges act between the wedges and the magnets to normally bias the wedges into engagement with the rail 25, the braking force being provided by the friction force between the wedges and the rail which then forces the wedges into wedging engagement with the brake block. The electromagnets are normally energized to exert an attracting force on the wedges sufficient to overcome the spring force to insure that during normal operation the friction force between the wedges and the rail is insufficient to cause the wedges to become wedged between the brake block and the rail. As indicated above, the permanent magnets 54 exert only enough force between the wedges and the rail to insure that the wedges stay in light contact with the rail so that there will be no lost motion when the wedges are put in an engaged condition when an overspeed condition occurs.

Figure 3:
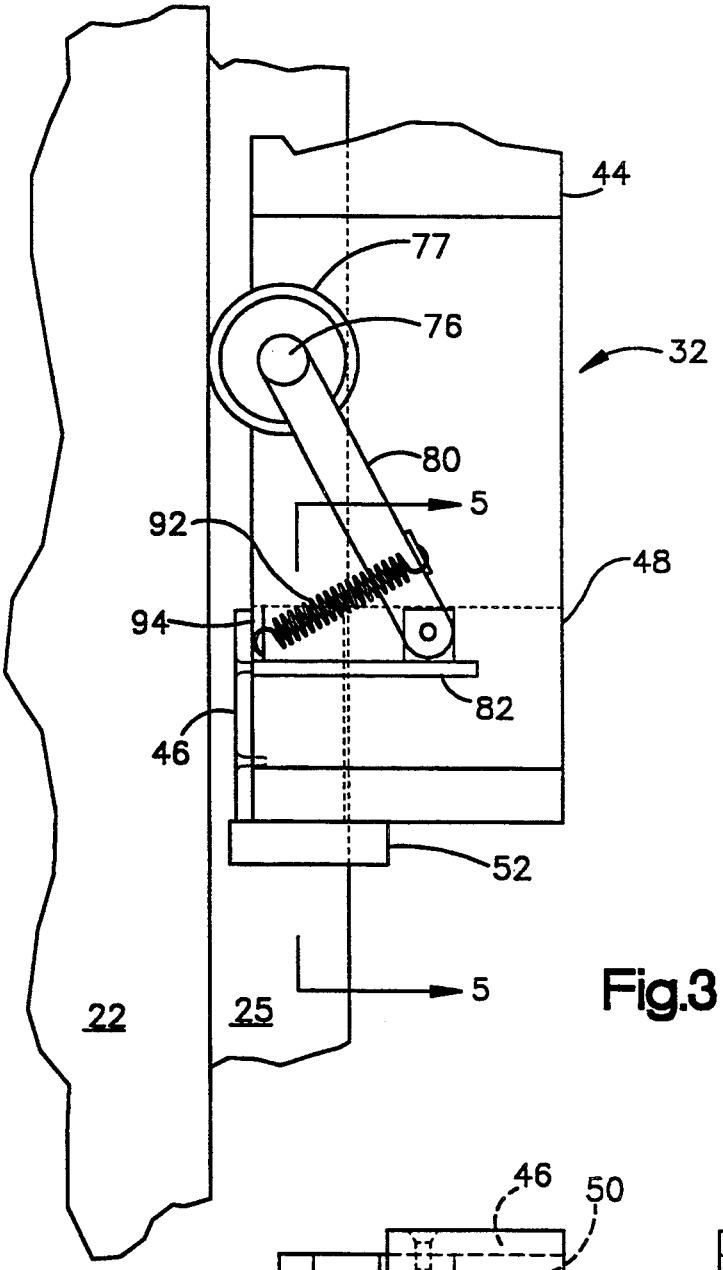
FIG. 3 is a side elevation view of the embodiment of FIG. 2.

Overspeed sensing is provided by a sensor system 74 which comprises a tachometer generator 76 driven by a wheel 77 engaged with the mast 22, and a controller 78 connected to the electromagnets 64 and 65. The controller is operative to energize the electromagnets and includes circuitry which converts the tach generator output into a signal which is effective to de-energize the electromagnets and thus remove the wedge retracting force against the springs 70 to permit the wedges to frictionally engage the rail 25. The tach generator is mounted on a frame 80 which is pivotally mounted on a platform 82 attached to side plate 42. The input shaft 84 of the tach generator is connected, through a coupling 86, to an axle 88 which is mounted for rotation in the frame 80 and which receives the wheel 77. Referring to FIG. 3, the wheel is held in engagement with the mast 22 by means of an extension spring 92 connected between the frame and a tab 94 formed on the platform 82. The controller 78 is set to open the electrical circuit to the electromagnets at a predetermined output signal provided by the tach generator. Such circuits are well known in the art and will not be described in detail herein. Since the output of the tach generator is proportional to the input speed as determined by the wheel 77, the predetermined signal is set at a level which is realized only when an overspeed condition occurs. It can be appreciated that a loss of electrical power to the SR vehicle will also cause the wedges to move into braking engagement with the rail.

Figure 6:
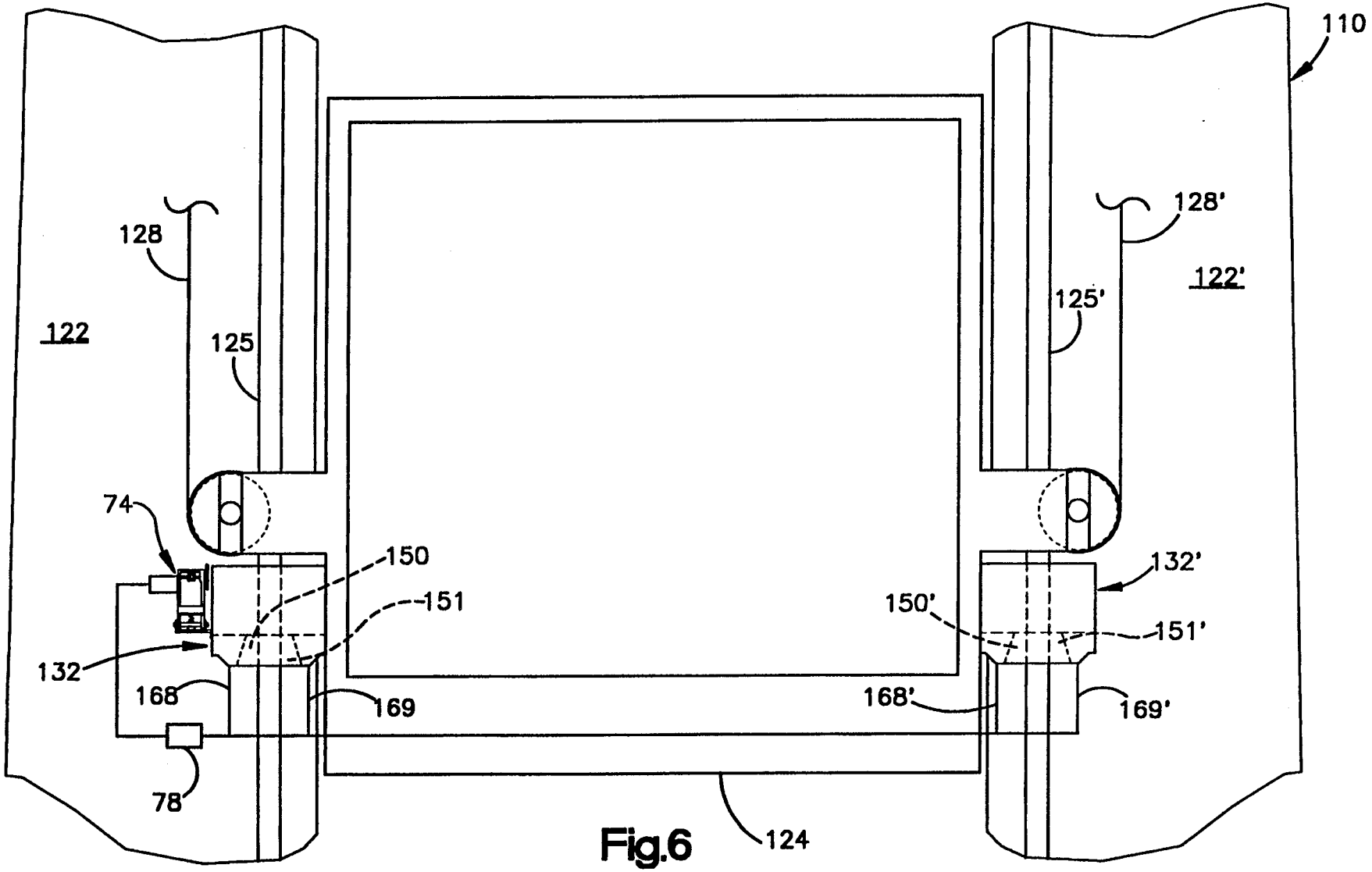
FIG. 6 is a schematic representation of the application of the invention to a double-masted SRV.

FIG. 6 illustrates the application of the FIG. 5 embodiment to a double-masted SRV 110 including masts 122 and 122' and a single load carriage 124. Each mast includes a guide rail 125 and 125', and the load carriage is driven up and down the masts by cable systems 128 and 128'. In this system, overspeed brake assemblies 132 and 132' are mounted on either side of the load carriage 124 and operate on the guide rails 125 and 125' respectively; however, a single sensor system 74 is mounted on one of the brake assemblies with the controller 78 connected in parallel to the brake assemblies. It should be noted that the permanent magnets 54 are particularly important in a double mast application since they insure that essentially no lost motion of the wedges 150, 151 or 150', 151' will occur when the electromagnets are deactivated by the sensor system 74, thus insuring that the engagement of the dual brake assemblies will be synchronized.

I claim:

1. A brake apparatus for a load carriage mounted for vertical movement along an elongated mast, comprising a brake block attached to said mast; one or more wedge members acting between said brake block and said mast, said one or more wedge members being movable between a first position permitting relative movement between said load carriage and said mast and a second position preventing relative movement between said load carriage and said mast; spring means biasing said one or more wedge members into said second position; permanent magnet means attached to said one or more wedge members in position to apply a magnetic attractive force to said mast; retracting means operable to apply a force to said one or more wedge members opposing said spring means to hold said one or more wedge members in said first position; and means responsive to the speed of said load carriage relative to said mast to remove said opposing force at a predetermined relative speed; said retracting means comprising one or more electromagnets attached to said brake block in position to apply a magnetic attracting force to said one or more wedge members.

2. Apparatus as claimed in claim 1 in which said speed responsive means comprises a tachometer generator having its input member in engagement with said mast to generate an electrical signal proportional to the relative speed between said load carriage and said mast, and control means connected to said one or more electromagnets and responsive to said signal to remove said attractive force when said relative speed reaches a predetermined value.

3. Apparatus as claimed in claim 1 in combination with a storage and retrieval machine comprising a first elongated mast mounted on said machine; a second elongated mast mounted on said machine in spaced parallel relation to the first mast; said load carriage being mounted for vertical movement between said first and second masts; said combination including a first brake apparatus comprising said one or more wedge members operatively acting between said load carriage and said first mast and a second brake apparatus comprising one or more wedge members operatively acting between said load carriage and said second mast.

4. Apparatus as claimed in claim 3 in which said speed responsive means comprises a tachometer generator having its input member in engagement with one of said first and second masts to generate an electrical signal proportional to the relative speed between said load carriage and said mast, and control means connected to said retracting means and operable to remove said opposing force holding said wedges in said first position in both said first and second brake apparatus.

* * * * *